US009566588B2

(12) United States Patent
Malec

(10) Patent No.: US 9,566,588 B2
(45) Date of Patent: Feb. 14, 2017

(54) RAPPING AN ELECTROSTATIC PRECIPITATOR

(71) Applicant: ALSTOM Technology Ltd, Baden (CH)

(72) Inventor: Ireneusz Malec, Malopolska (PL)

(73) Assignee: General Electric Technology GmbH, Baden (CH)

( * ) Notice: Subject to any disclaimer, the term of this patent is extended or adjusted under 35 U.S.C. 154(b) by 245 days.

(21) Appl. No.: 14/315,499

(22) Filed: Jun. 26, 2014

(65) Prior Publication Data

US 2014/0305301 A1 Oct. 16, 2014

Related U.S. Application Data

(63) Continuation of application No. PCT/IB2013/050629, filed on Jan. 24, 2013.

(30) Foreign Application Priority Data

Jan. 26, 2012 (EP) ..... 12461503

(51) Int. Cl.
*B03C 3/76* (2006.01)

(52) U.S. Cl.
CPC ..... *B03C 3/761* (2013.01); *B03C 3/76* (2013.01); *Y10T 29/49826* (2015.01)

(58) Field of Classification Search
CPC combination set(s) only.
See application file for complete search history.

(56) References Cited

U.S. PATENT DOCUMENTS 3,853,511 A * 12/1974 Huppi ..... B03C 3/88 96/32
3,951,624 A * 4/1976 Snader ..... B03C 3/36 96/60

(Continued)

FOREIGN PATENT DOCUMENTS

CN 85200192 U 9/1985
CN 2303684 Y 1/1999

(Continued)

OTHER PUBLICATIONS

European Search Report for EP Application No. 12461503.0 dated Jul. 12, 2003.

*Primary Examiner* — Sonji Turner
(74) *Attorney, Agent, or Firm* — GE Global Patent Operation; Rita D. Vacca

(57) ABSTRACT

For the sake of improving dust removal from an electrostatic precipitator by rapping, the present disclosure proposes an electrostatic precipitator, comprising a flue gas chamber, a collecting electrode, a first rapping arrangement that raps the collecting electrode, a dust hopper, and a second rapping arrangement that raps at least one of the dust hopper and an element located within the dust hopper, wherein the second rapping arrangement is located within an inner chamber defined by the flue gas chamber and the dust hopper. The rapping by means of the second rapping arrangement may comprise rapping at least one of an inner wall of the dust hopper, a structural element located within the dust hopper and connected to at least one inner wall of the dust hopper, a rapping plate located within the dust hopper proximate to an inner wall of the dust hopper, and a baffle located within the dust hopper.

15 Claims, 5 Drawing Sheets

(56) References Cited

U.S. PATENT DOCUMENTS

| | | | | | |
|---|---|---|---|---|---|
| 4,026,683 | A * | 5/1977 | Snader | B03C 3/88 | 96/37 |
| 4,218,225 | A * | 8/1980 | Kirchhoff | B03C 3/025 | 55/419 |
| 4,968,330 | A * | 11/1990 | Wolf | B03C 3/011 | 96/32 |
| 5,009,677 | A * | 4/1991 | Wolf | B03C 3/011 | 95/76 |
| 5,160,510 | A | 11/1992 | Steinbacher et al. | | |
| 7,828,876 | B2 * | 11/2010 | Klemm | B01D 45/08 | 55/424 |
| 2008/0257148 | A1 * | 10/2008 | Klemm | B01D 45/08 | 95/57 |

FOREIGN PATENT DOCUMENTS

| | | | |
|---|---|---|---|
| DE | 447137 | | 7/1927 |
| DE | 3737926 | | 6/1988 |
| EP | 1967275 | A1 | 9/2008 |
| GB | 631586 | | 11/1949 |
| JP | S60-86461 | | 6/1985 |
| JP | 60-225659 | | 11/1985 |
| JP | S63218267 | A | 9/1988 |
| JP | H01-180259 | | 7/1989 |
| JP | 7-246348 | | 9/1995 |
| JP | H0971118 | A | 3/1997 |
| JP | H1077130 | A | 3/1998 |
| JP | 10-216560 | | 9/1998 |
| JP | 2002253988 | A | 9/2002 |

* cited by examiner

RAPPING AN ELECTROSTATIC PRECIPITATOR

CROSS-REFERENCE TO RELATED APPLICATIONS

This application claims priority to PCT/IB2013/050629 filed Jan. 24, 2013, which claims priority to European application 12461503.0 filed Jan. 26, 2012, both of which are hereby incorporated in their entireties.

BACKGROUND OF THE INVENTION

Field of the Disclosure

The present disclosure relates to an electrostatic precipitator, to a method of modifying an electrostatic precipitator as well as to a method of rapping an electrostatic precipitator.

Description of the Related Art

Electrostatic precipitators are well known for removing particulate matter from a gaseous stream. For example, electrostatic precipitators are commonly found in industrial facilities where the combustion of coal, oil, industrial waste, town refuse, peat, biomass, or other fuels produces flue gases that contain particulate matter, e.g. fly ash. In other industrial processes the particulate matter consisting a fly dust or powder which is separated from a gaseous stream in an electrostatic precipitator.

Electrostatic precipitators operate by creating an electrostatic field between electrodes of at least two electrode systems. A first of these electrode systems typically has electrodes of a plate-like shape that are connected to a power supply so as to carry a positive charge. Such an electrode is commonly designated as a collecting electrode or collecting plate. A second of these electrode systems has electrodes typically embodied in the form of a wire or a pointed pipe that are connected to said power supply so as to carry a negative charge. Such an electrode is commonly designated as an emission electrode or discharge electrode. Particulate matter in a gaseous stream passing by the second electrode is likewise given a negative charge and is thus attracted to and retained by the positive charge on the collecting electrode.

Over time, particulate matter accumulates on the collecting electrode, thus diminishing the efficiency with which the electrostatic precipitator can remove particulate matter from the gaseous stream. To combat this problem, it is well known to mechanically hammer against the collecting electrode, a technique known as rapping. This rapping of the collecting electrode causes particulate matter (often termed "dust") to fall from the collecting electrode into a collecting bin (often termed a "dust hopper") provided therebelow, thus at least partially cleansing the collecting electrode of particulate matter.

The particulate matter that has fallen into the dust hopper is transported away, e.g. by means of a screw, a drag chain conveyor, a conveyor belt or other dust evacuation/transport system, and is properly disposed of in accordance with local laws.

It is an object of the present disclosure to improve upon this prior art.

BRIEF SUMMARY OF THE DISCLOSURE

Generally speaking, the present disclosure teaches provision of a rapping mechanism that raps the dust hopper and/or elements located within the dust hopper using a rapping mechanism that is located entirely within the electrostatic precipitator.

Since the rapping mechanism is provided entirely within the electrostatic precipitator, the rapping mechanism will adopt the ambient temperature within the electrostatic precipitator, thus avoiding the formation of condensation on the rapping mechanism that could moisten the particulate matter and cause it to clump or cling to the hopper walls or to other elements provided within the hopper. This inhibition of condensation also reduces the occurrence of "wet spots," thus reducing corrosion of the dust chamber.

Since the rapping mechanism raps the dust hopper from the inside or raps elements with the dust hopper, the dust hopper does not need to be built as stably as if the dust hopper were to be rapped from the outside, i.e. against the insulating walls of the hopper.

Since the rapping mechanism is provided within the electrostatic precipitator, the rapping mechanism may be driven together with a rapping mechanism for rapping collecting plates of the electrostatic precipitator. This not only simplifies retrofitting of existing systems, but also ensures that the dust hopper is rapped at the same time as the collecting plates of the electrostatic precipitator, which also helps to avoid the aforementioned clumping/clinging of the particulate matter.

Since the rapping mechanism is provided within the electrostatic precipitator, any noise produced by the rapping mechanism is dampened by the walls of the flue gas chamber and the dust hopper, in particular by the thermal insulation provided on such walls.

Since the rapping mechanism is provided within the electrostatic precipitator, retrofitting can be carried out easily.

In accordance with a first aspect, the present disclosure teaches an electrostatic precipitator comprising a flue gas chamber, a collecting electrode, a first rapping arrangement that raps the collecting electrode and a dust hopper. The electrostatic precipitator may furthermore comprise a discharge electrode as well as a power source that is connected to the collecting electrode and the discharge electrode and generates an electric field between the collecting electrode and the discharge electrode. The collecting electrode (and the discharge electrode) may be located in the flue gas chamber.

The collecting electrode may have a plate-like shape and may be a metallic plate. The discharge electrode may have the shape of a wire, rod or pipe with spikes and may likewise be made of metal. The electrostatic precipitator may comprise a plurality of collecting electrodes and/or discharge electrodes as described in the present disclosure.

The flue gas chamber may have an inlet through which an inflow of gas to be cleansed enters the flue gas chamber. The flue gas chamber may also have an outlet through which an outflow of gas that has been cleansed by the electrostatic precipitator exits the flue gas chamber.

The first rapping arrangement may comprise at least one rapping hammer. The rapping hammer may be arranged to rap against the collecting electrode or against a shock bar that is connected to or acts against the collecting electrode. Accordingly, the first rapping arrangement may comprise at least one such shock bar. The rapping hammer may be a tumbling hammer connected to a rotating shaft. A plurality of rapping hammers may be connected to the shaft, each of the hammers rapping a respective set of one or more collecting electrodes. Each rapping hammer may rap the respective set of collecting electrodes once per rotation of the shaft. The rapping hammers may be arranged on the shaft such that the rapping performed by the individual rapping hammers per rotation of the shaft occurs at irregular intervals. This not only avoids an accumulation of forces, but also reduces the perceived loudness of the rapping. The rapping hammer and/or the shock bar may be made of metal.

The flue gas chamber may have one or more chamber openings that allow passage of particulate matter from the flue gas chamber into the dust hopper. The flue gas chamber and the dust hopper may be arranged such that particulate matter that has been rapped from the collecting electrode is transported by the force of gravity from the flue gas chamber to the dust hopper. The electrostatic precipitator may comprise a dust evacuation/transport system, e.g. a drag chain conveyor, a conveyor belt or a screw mechanism, that automatically removes particulate matter from the dust hopper, e.g. particulate matter that has accumulated in the dust hopper. The dust hopper may comprise hopper openings that receive respective parts of the dust evacuation/transport system and/or for allowing evacuation/transport of the particulate matter from the dust hopper.

The flue gas chamber may be a substantially or essentially closed chamber excepting the aforementioned inlet, outlet and openings. In other words, the flue gas chamber may be formed by a plurality of walls that form a substantially or essentially closed chamber excepting the aforementioned inlet, outlet and chamber openings. One or more or all of the walls may be made of sheet metal.

The dust hopper may be arranged adjacent the flue gas chamber such that the dust hopper forms a substantially or essentially closed chamber excepting the aforementioned chamber openings and hopper openings. In other words, the dust hopper may be formed by a plurality of (inner) walls that, together with one or more walls of the flue gas chamber, form a substantially or essentially closed chamber excepting the aforementioned chamber openings and hopper openings.

The dust hopper may have substantially the shape of a "V" or substantially the shape of a pyramid. The wide portion of the "V" or the base of the pyramid may be adjacent the flue gas chamber.

The electrostatic precipitator may comprise a plurality of dust hoppers as described in the present disclosure.

Together, the flue gas chamber and the dust hopper(s) may define an inner chamber. The inner chamber may be a substantially or essentially closed chamber excepting the aforementioned inlet, outlet and hopper openings. The inner chamber substantially contains the gas passing from the inlet to the outlet and the particulate matter cleansed from that gas, i.e. substantially prevents the gas and particulate matter from escaping into the ambient atmosphere. The walls of the flue gas chamber and the dust hopper(s) that constitute a perimeter of the inner chamber may be insulated.

The dust hopper may comprise one or more structural elements, e.g. for increasing the stability of the dust hopper, e.g. for preventing the dust hopper from bulging under the weight of the particulate matter. In this respect, any of the structural elements may be connected to at least one inner wall of the dust hopper. Any of the structural elements may be located inside the dust hopper. Any of the structural elements may span across the inside of the dust hopper from one inner wall of the dust hopper to another inner wall of the dust hopper.

The electrostatic precipitator may comprise one or more baffles for inhibiting a flow of the gas (passing from the inlet to the outlet) through the dust hopper. Any of the baffles may be located within or at least partially within the dust hopper. The baffles may be metallic plates. The baffles may be hung from chains, wires and/or suspension beams within the electrostatic precipitator.

The electrostatic precipitator may comprise a second rapping arrangement. The second rapping arrangement may rap the dust hopper. The second rapping arrangement may rap an element within the dust hopper. The second rapping arrangement thus inhibits a clogging and clinging of particulate matter in the dust hopper.

For example, the electrostatic precipitator may comprise at least one rapping plate that is rapped by the second rapping arrangement. The rapping plate may be located proximate to, adjacent to and/or along an inner wall of the dust hopper. The rapping plate may be suspended within the dust hopper by chains or wires. The rapping plate may be a metallic plate. Rapping of such a rapping plate can provide a rapping effect similar to rapping an inner wall of the dust hopper, yet without incurring significant vibration of the dust hopper.

The second rapping arrangement may rap at least one inner wall of the dust hopper. The second rapping arrangement may rap any of the aforementioned structural elements, e.g. against structural elements located inside the dust hopper. The second rapping arrangement may rap any of the baffles. The second rapping arrangement may rap at least one of an inner wall of the dust hopper, a structural element connected to at least one inner wall of said dust hopper and a baffle located within said dust hopper.

The second rapping arrangement may comprise at least one rapping hammer. The rapping hammer may be arranged to rap against the rapped element (e.g. inner wall, structural element, rapping plate and/or baffle) or against a shock bar that is connected to or acts against the rapped element(s). Accordingly, the second rapping arrangement may comprise at least one such shock bar. The shock bar may be supported by one or more support elements. The support elements may be fastened to any of the aforementioned structural elements. The rapping hammer may be a tumbling hammer connected to a rotating shaft. A plurality of rapping hammers may be connected to the shaft, each of the hammers rapping a respective rapped element or shock bar. Each rapping hammer may rap the respective rapped element or shock bar once per rotation of the shaft. The rapping hammers may be arranged on the shaft such that the rapping performed by the individual rapping hammers per rotation of the shaft occurs at irregular intervals. This not only avoids an accumulation of forces, but also reduces the perceived loudness of the rapping. The rapping hammer and/or the shock bar may be made of metal.

The second rapping arrangement may be located in the inner chamber. In other words, the second rapping arrangement may be located in the flue gas chamber or in the dust hopper or the second rapping arrangement may be positioned such that part of the second rapping arrangement is located in the flue gas chamber and the remaining part of the second rapping arrangement is located in the dust hopper. The second rapping arrangement may be configured such that a rapping hammer of the second rapping arrangement is located in the flue gas chamber and that a shock bar of the second rapping arrangement extends from a location in the flue gas chamber proximal to the rapping hammer to a location of the rapped element in the dust hopper.

The electrostatic precipitator may comprise a mechanical connection interconnecting the first rapping arrangement and the second rapping arrangement such that a driving of the first rapping arrangement effects a driving of the second rapping arrangement. The mechanical connection may comprise a chain, a shaft and/or a gear system. For example, one or more rapping hammers of the first rapping arrangement and one or more rapping hammers of the second rapping arrangement may be mounted on a common shaft. Similarly, a shaft on which one or more rapping hammers of the first rapping arrangement are mounted may be connected, e.g. by a chain or a gear system, to a shaft on which one or more rapping hammers of the second rapping arrangement are mounted.

The electrostatic precipitator may comprise a first drive system that drives the first rapping arrangement. The first drive system may include an electric motor. The first drive system may include a shaft on which one or more rapping hammers of the first rapping arrangement are mounted. For example, electrostatic precipitator may comprise an electric motor that directly or indirectly drives the first rapping arrangement, e.g. that directly or indirectly drives a shaft on which one or more rapping hammers of the first rapping arrangement are mounted. The first drive system may be located inside the inner chamber or at least partially outside the inner chamber.

The electrostatic precipitator may comprise a second drive system that drives the second rapping arrangement. The second drive system may include an electric motor. The second drive system may include a shaft on which one or more rapping hammers of the second rapping arrangement are mounted. For example, electrostatic precipitator may comprise an electric motor that directly or indirectly drives the second rapping arrangement, e.g. that directly or indirectly drives a shaft on which one or more rapping hammers of the second rapping arrangement are mounted. The second drive system may be located inside the inner chamber or at least partially outside the inner chamber.

The electrostatic precipitator may comprise a control system. The control system may be configured to control the first drive system and the second drive system such that a driving of the first drive system and a driving of the second drive system occur at least in part simultaneously.

In accordance with a second aspect, the present disclosure teaches a method of modifying an electrostatic precipitator. The method of modifying an electrostatic precipitator may comprise equipping/retrofitting an electrostatic precipitator with any of the features described hereinabove.

In accordance with a third aspect, the present disclosure teaches a method of rapping an electrostatic precipitator. The method of rapping an electrostatic precipitator may comprise rapping an electrostatic precipitator having any of the aforementioned features in any manner as described hereinabove.

BRIEF DESCRIPTION OF THE DRAWINGS

The novel features of the invention, as well as the invention itself, both as to its structure and its operation will be best understood from the accompanying figures, taken in conjunction with the accompanying description. The Figures show.

DETAILED DESCRIPTION OF THE DRAWINGS

Figure 1:
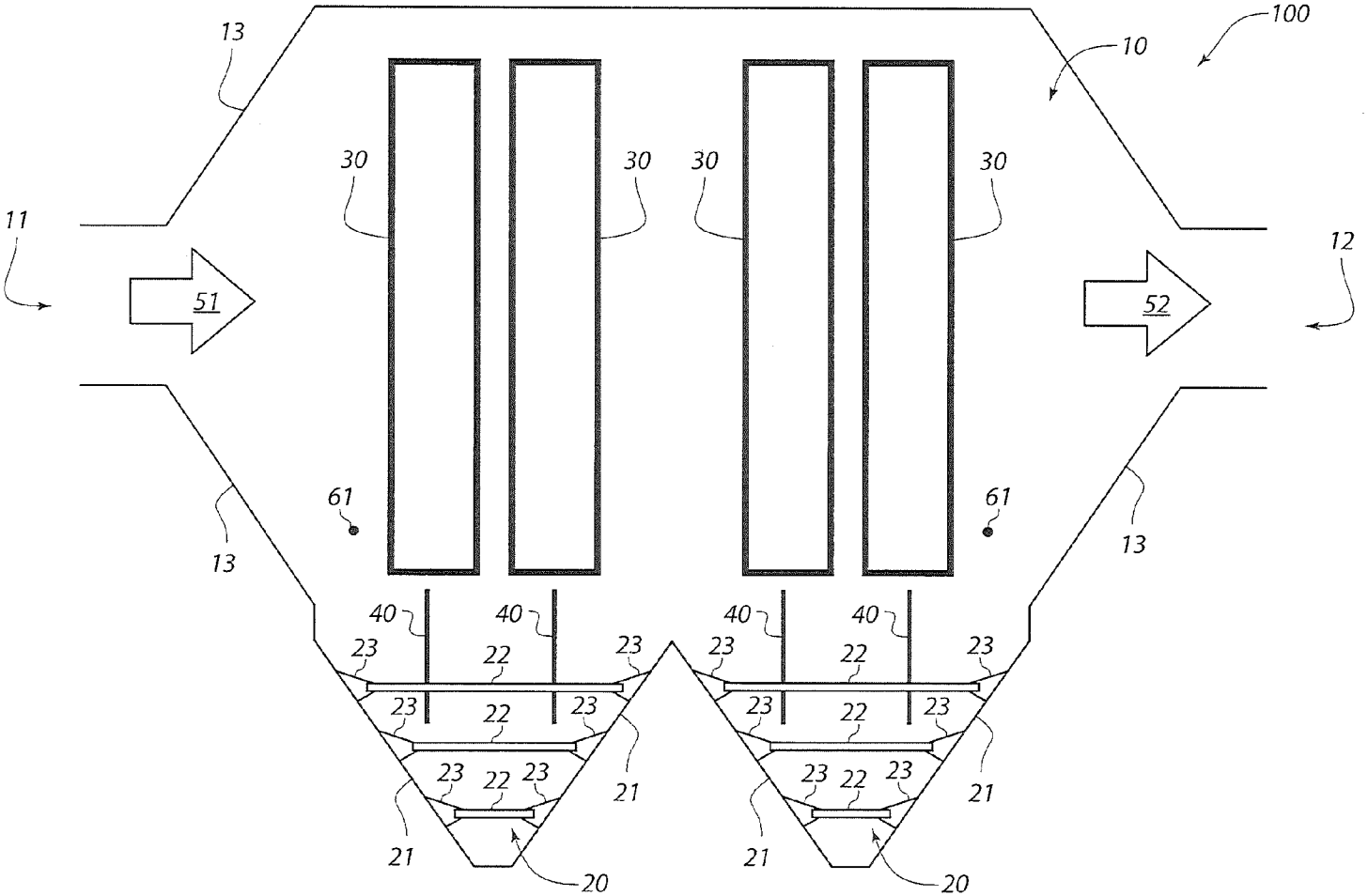
FIG. 1 a schematic view of an exemplary embodiment of an electrostatic precipitator in accordance with the present disclosure.

FIG. 1 is a schematic view of an exemplary embodiment of an electrostatic precipitator 100 in accordance with the present disclosure, e.g. as described hereinabove.

In the exemplary embodiment illustrated in FIG. 1, electrostatic precipitator 100 comprises an inlet 11 for a inflow of gas 51 that contains particulate matter, e.g. fly ash, and an outlet 12 for outflow of gas 52 from which most of the particulate matter has been removed. Inflowing gas 51 may be a flue gas, for example, from a furnace in which coal is combusted.

Electrostatic precipitator 100 comprises a flue gas chamber 10 as well as a plurality of walls 13 that substantially define flue gas chamber 10. Flue gas chamber 10, i.e. walls 13, provides part of a containment for the gas as it flows from inlet 11 to outlet 12.

Electrostatic precipitator 100 comprises a plurality of collecting electrodes 30. Together with one or more discharge electrodes and one or more power supplies as known in the art, collecting electrodes 30 are capable of cleansing particulate matter from inflowing gas 51. Specifically, the particulate matter accumulates on collecting electrodes 30.

Electrostatic precipitator 100 comprises a first rapping arrangement 60 (not shown in FIG. 1) that raps the collecting electrodes 30 to dislodge the particulate matter that has accumulated thereon. First rapping arrangement includes a shaft 61.

Electrostatic precipitator 100 comprises one or more dust hoppers 20 as well as a plurality of walls 21 that substantially define dust hoppers 20. Dust hoppers 20 are positioned so as to collect the particulate matter that has been rapped from collecting electrodes 30. A dust evacuation/transport system, e.g. a conveyor belt 80, (not shown in FIG. 1) may be provided to automatically transport the particulate matter collected in dust hoppers 20 away for appropriate disposal.

Dust hoppers 20 comprise a plurality of structural elements in the form of crossbars 22 that are fastened by means of connection elements 23 to walls 21. The structural elements, in this case crossbars 22, thus provide stiffening for walls 21 to counter the weight of the particulate matter in dust hoppers 20.

Electrostatic precipitator 100 comprises a plurality of baffles 40 that inhibit inflowing gas 51 from flowing through dust hoppers 20 as it passes from inlet 11 to outlet 12.

Figure 2:
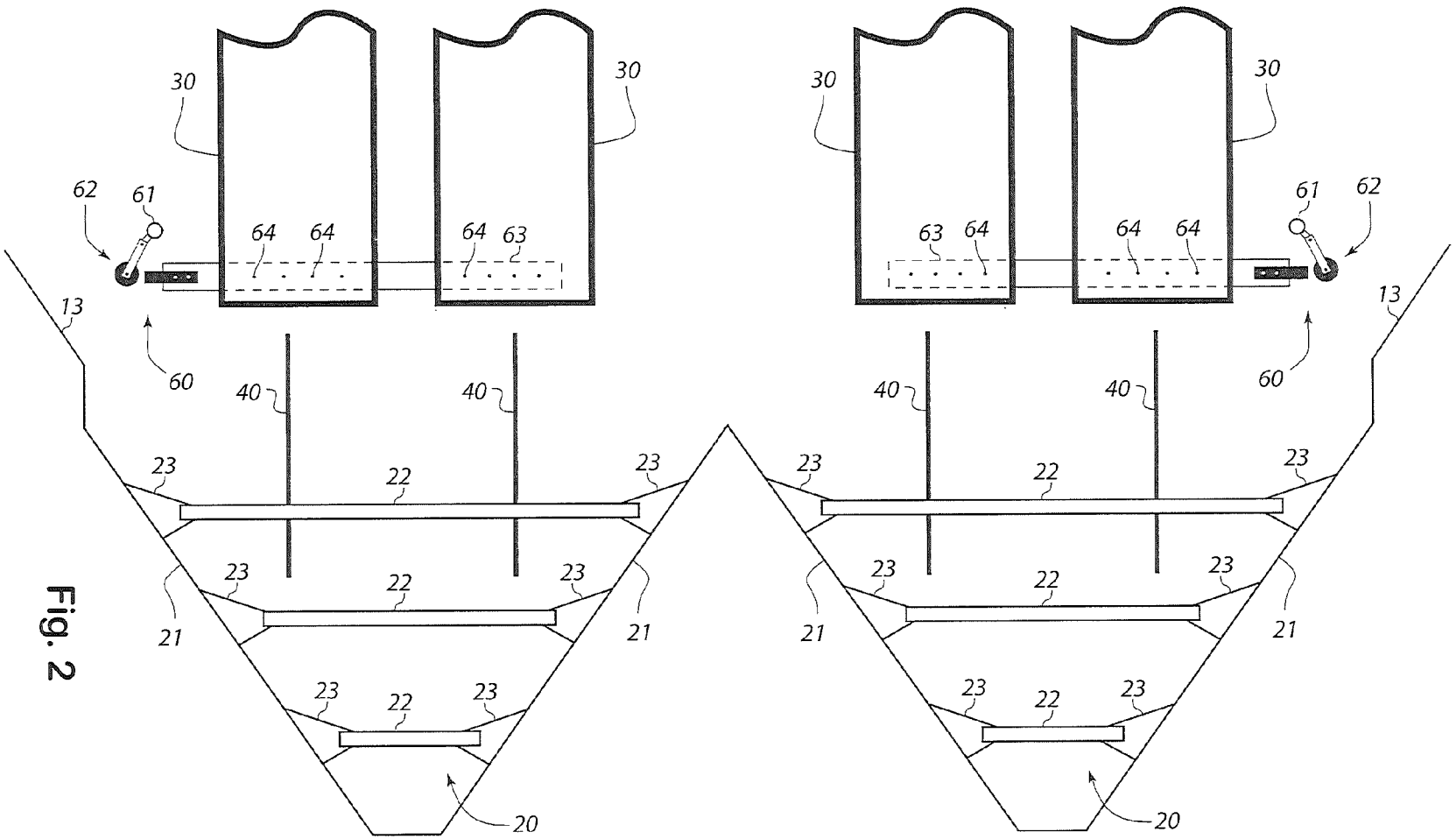
FIG. 2 a schematic view of an exemplary embodiment of a first rapping arrangement in accordance with the present disclosure.

FIG. 2 is a schematic view of an exemplary embodiment of a first rapping arrangement 60 in accordance with the present disclosure, e.g. as described hereinabove.

For the sake of better understanding, FIG. 2 also shows features of an electrostatic precipitator. Since those features have already been described hereinabove, their constitution and function will not be reiterated.

In the exemplary embodiment illustrated in FIG. 2, first rapping arrangement 60 comprises a rapping hammer 62 and a shock bar 63. In the illustrated embodiment, rapping hammer 62 is a tumbling hammer that is connected to and rotates with a shaft 61. Rapping hammer 62 is arranged so as to rap against shock bar 63 once per rotation of shaft 61. Shock bar 63 is connected to collecting plates 30 by a plurality of fasteners 64. Accordingly, the rapping of rapping hammer 62 against shock bar 63 is transmitted to collecting plates 30, which effects a dislodging of particulate matter clinging to collecting plates 30. The dislodged particulate matter then falls into dust hoppers 20 as described above.

Figure 3:
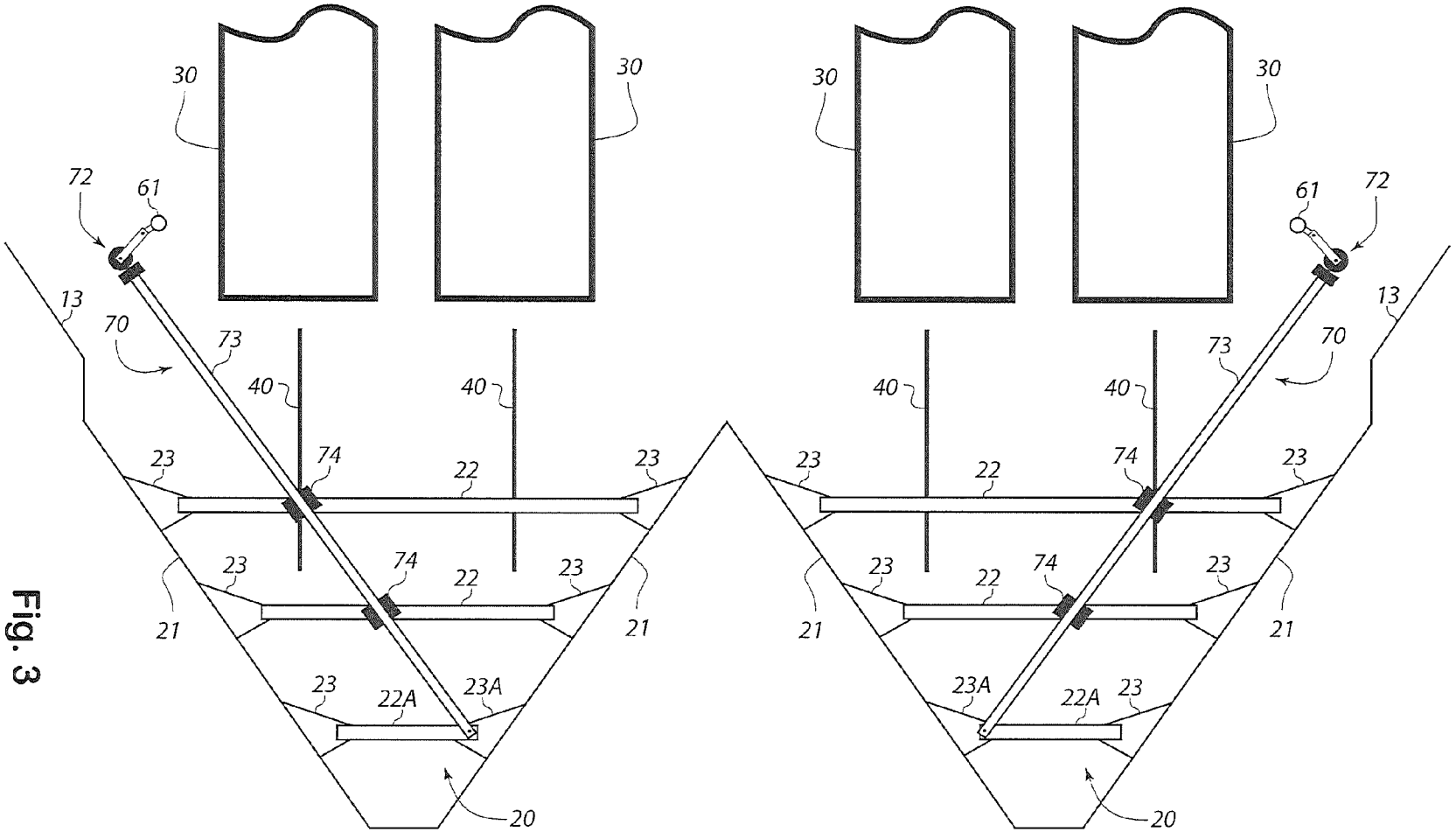
FIG. 3 a schematic view of an exemplary embodiment of a second rapping arrangement in accordance with the present disclosure.

FIG. 3 is a schematic view of an exemplary embodiment of a second rapping arrangement 70 in accordance with the present disclosure, e.g. as described hereinabove.

For the sake of better understanding, FIG. 3 also shows features of an electrostatic precipitator. Since those features have already been described hereinabove, their constitution and function will not be reiterated.

In the exemplary embodiment illustrated in FIG. 3, second rapping arrangement 70 comprises a rapping hammer 72 and a shock bar 73. In the illustrated embodiment, rapping hammer 72 is a tumbling hammer that is connected to and rotates with a shaft 61. Rapping hammers 62 of a first rapping arrangement 60 that raps collecting electrodes 30 may also be mounted on shaft 61. Rapping hammer 72 is arranged so as to rap against shock bar 73 once per rotation of shaft 61. Shock bar 73 is moveably supported, e.g. slidingly supported, by a plurality of guides 74 that are mounted on crossbars 22 of dust hopper 20. Shock bar 73 is connected to crossbar 22A and connection element 23A that, in turn, are connected to walls 21 of dust hopper 20. Accordingly, the rapping of rapping hammer 72 against shock bar 73 is transmitted to walls 21 of dust hopper 20, which inhibits clinging and clogging of particulate matter in dust hopper 20.

Figure 4:
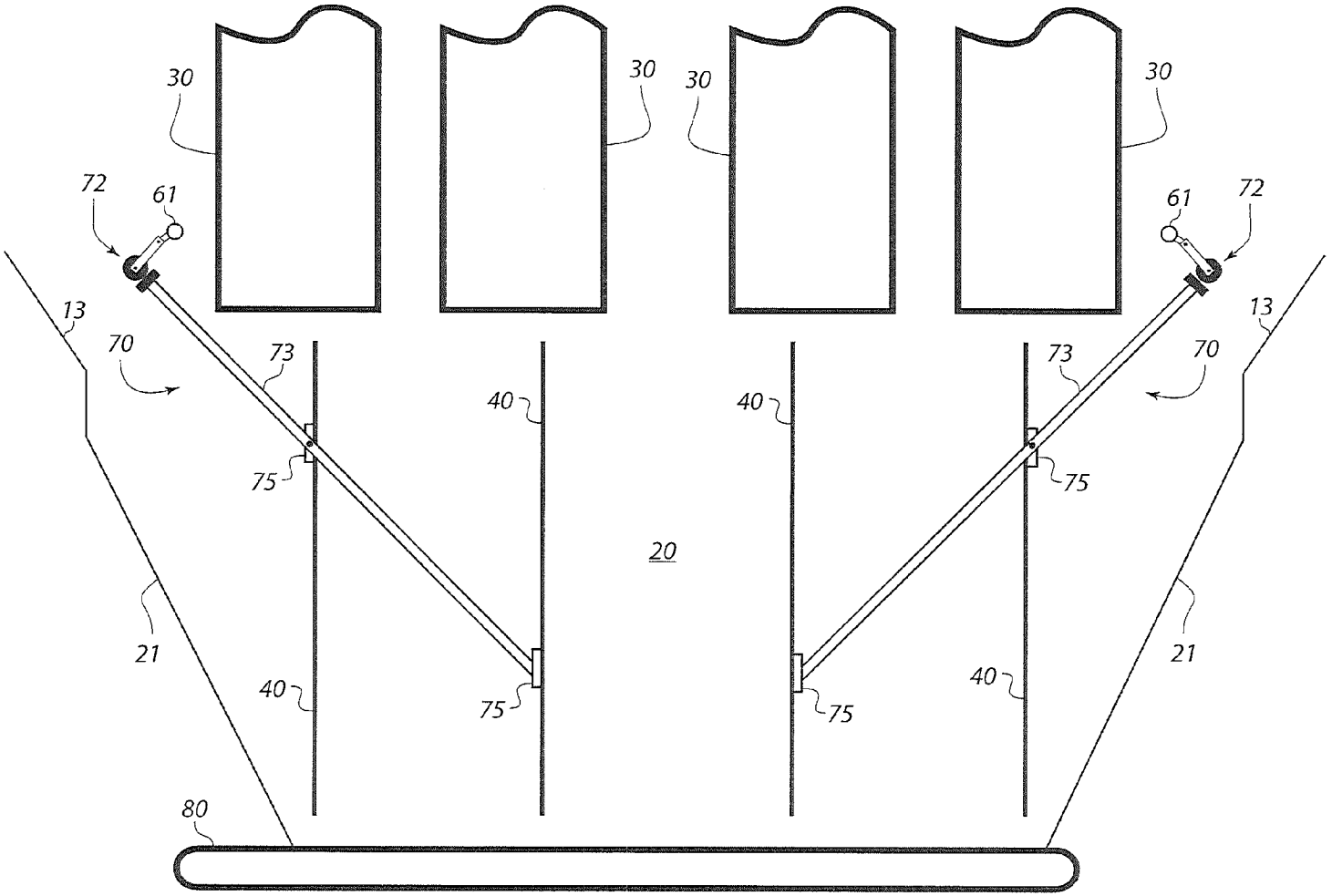
FIG. 4 a schematic view of another exemplary embodiment of a second rapping arrangement in accordance with the present disclosure.

FIG. 4 is a schematic view of another exemplary embodiment of a second rapping arrangement 70 in accordance with the present disclosure, e.g. as described hereinabove.

For the sake of better understanding, FIG. 4 also shows features of an electrostatic precipitator. Since those features have already been described hereinabove, their constitution and function will not be reiterated.

In the exemplary embodiment illustrated in FIG. 4, second rapping arrangement 70 comprises a rapping hammer 72 and a shock bar 73. In the illustrated embodiment, rapping hammer 72 is a tumbling hammer that is connected to and rotates with a shaft 61. Rapping hammers 62 of a first rapping arrangement 60 that raps collecting electrodes 30 may also be mounted on shaft 61. Rapping hammer 72 is arranged so as to rap against shock bar 73 once per rotation of shaft 61. Shock bar 73 is fastened to baffles 40 by fastening elements 75. Accordingly, the rapping of rapping hammer 72 against shock bar 73 is transmitted to baffles 40, which inhibits clinging and clogging of particulate matter in dust hopper 20.

FIG. 4 also shows a conveyor belt 80 located at a bottom portion of dust hopper 20. Conveyor belt 80 transports particulate matter away for disposal that has fallen to the bottom dust hopper 20.

Figure 5:
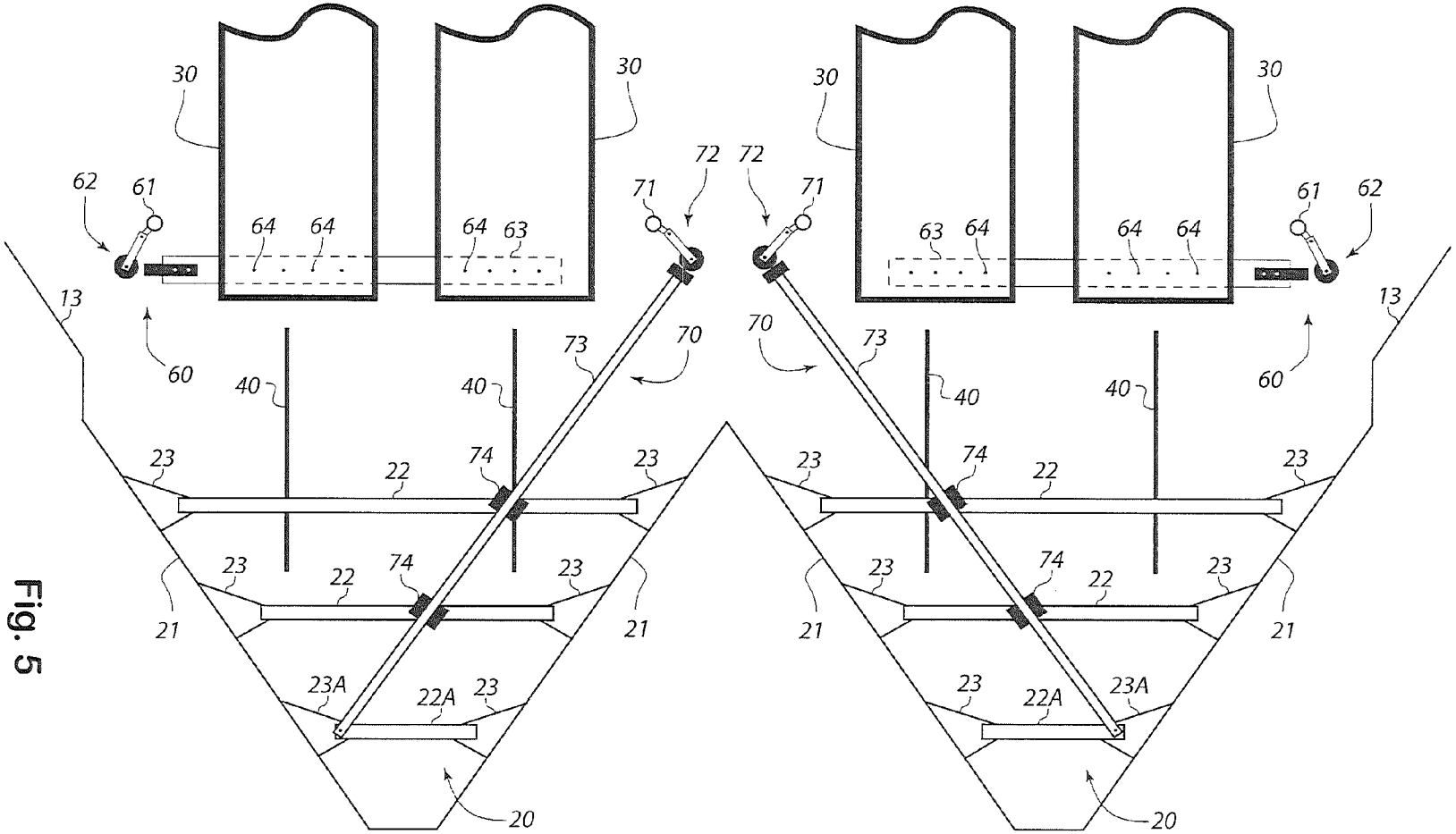
FIG. 5 a schematic view of yet another exemplary embodiment of a second rapping arrangement in accordance with the present disclosure.

FIG. 5 is a schematic view of another exemplary embodiment of a second rapping arrangement 70 in accordance with the present disclosure, e.g. as described hereinabove.

For the sake of better understanding, FIG. 5 also shows features of an electrostatic precipitator. Since those features have already been described hereinabove, their constitution and function will not be reiterated.

In the exemplary embodiment illustrated in FIG. 5, second rapping arrangement 70 comprises a rapping hammer 72 and a shock bar 73. In the illustrated embodiment, rapping hammer 72 is a tumbling hammer that is connected to and rotates with a shaft 71. Rapping hammer 72 is arranged so as to rap against shock bar 73 once per rotation of shaft 71. Shock bar 73 is moveably supported, e.g. slidingly supported, by a plurality of guides 74 that are mounted on crossbars 22 of dust hopper 20. Shock bar 73 is connected to crossbar 22A and connection element 23A that, in turn, are connected to walls 21 of dust hopper 20. Accordingly, the rapping of rapping hammer 72 against shock bar 73 is transmitted to walls 21 of dust hopper 20, which inhibits clinging and clogging of particulate matter in dust hopper 20.

Shaft 71 may be mechanically connected to a shaft 61, e.g. by a combination of chains, shafts and/or gears. Rapping hammers 62 of a first rapping arrangement 60 that raps collecting electrodes 30 may be mounted on shaft 61. Accordingly, a driving of the first rapping arrangement effects a driving of the second rapping arrangement, which inhibits clinging and clogging of particulate matter in dust hopper 20.

Shaft 61 may be driven by or part of a first drive system, and shaft 71 may be driven by or part of a second drive system that is independent of the first drive system. Driving of the first drive system and the second drive system may be controlled by a common controller such that driving of the first drive system and the second drive system occurs, at least in part, simultaneously. This likewise inhibits clinging and clogging of particulate matter in dust hopper 20.

While various embodiments of the present invention have been disclosed and described in detail herein, it will be apparent to those skilled in the art that various changes may be made to the configuration, operation and form of the invention without departing from the spirit and scope thereof. In particular, it is noted that the respective features of the invention, even those disclosed solely in combination with other features of the invention, may be combined in any configuration excepting those readily apparent to the person skilled in the art as nonsensical. Likewise, use of the singular and plural is solely for the sake of illustration and is not to be interpreted as limiting.

The invention claimed is:

1. An electrostatic precipitator comprising:

a flue gas chamber;

a collecting electrode;

a first rapping arrangement that raps said collecting electrode, the first rapping arrangement comprising a hammer, a rotating shaft and a shock bar;

a dust hopper; and a second rapping arrangement that raps at least one of said dust hopper and an element located within said dust hopper, the second rapping arrangement comprising a hammer, a rotating shaft and a shock bar, wherein said second rapping arrangement is located within both said flue gas chamber and said dust hopper, together defining an inner chamber.

2. The electrostatic precipitator of claim 1, wherein the second rapping arrangement raps at least one of:

an inner wall of said dust hopper;

a structural element located within said dust hopper and connected to at least one inner wall of said dust hopper;

a rapping plate located within said dust hopper proximate to an inner wall of said dust hopper; and a baffle located within said dust hopper.

3. The electrostatic precipitator of claim 1 further comprising a mechanical connection interconnecting said first rapping arrangement and said second rapping arrangement such that a driving of said first rapping arrangement effects a driving of said second rapping arrangement.

4. The electrostatic precipitator of claim 1, wherein said first rapping arrangement comprises a rapping hammer mounted on a rotating shaft, and said second rapping arrangement comprises a rapping hammer mounted on a rotating shaft, for raps of the rapping hammers against the shock bars once per rotation of the rotating shafts.

5. The electrostatic precipitator of claim 1, further comprising:

a first drive system that drives said first rapping arrangement;

a second drive system that drives said second rapping arrangement; and a control system that controls said first drive system and said second drive system such that a driving of said first rapping arrangement and a driving of said second rapping arrangement occur at least in part simultaneously.

6. The electrostatic precipitator of claim 1, wherein the shock bar of the second rapping arrangement is supported by a plurality of guides.

7. A method of modifying an electrostatic precipitator comprising a flue gas chamber, a collecting electrode, a first rapping arrangement that raps said collecting electrode, the first rapping arrangement comprising a hammer, a rotating shaft and a shock bar and a dust hopper, said method comprising:

equipping said electrostatic precipitator with a second rapping arrangement comprising a hammer, a rotating shaft and a shock bar, to rap at least one of said dust hopper and an element located within said dust hopper, wherein said second rapping arrangement is located within both said flue gas chamber and said dust hopper, together defining an inner chamber.

8. The method of claim 7, wherein the second rapping arrangement raps at least one of:

an inner wall of said dust hopper;

a structural element located within said dust hopper and connected to at least one inner wall of said dust hopper;

a rapping plate located within said dust hopper proximate to an inner wall of said dust hopper; and a baffle located within said dust hopper.

9. The method of claim 7, further comprising:

equipping said electrostatic precipitator with a mechanical connection interconnecting said first rapping arrangement and said second rapping arrangement such that a driving of said first rapping arrangement effects a driving of said second rapping arrangement.

10. The method of claim 7, wherein said first rapping arrangement comprises a rapping hammer mounted on a rotating shaft and said second rapping arrangement comprises a rapping hammer mounted on a rotating shaft, for raps of the rapping hammers against the shock bars once per rotation of the rotating shafts.

11. The method of claim 7, wherein said electrostatic precipitator comprises a first drive system that drives said first rapping arrangement and a control system that controls said first drive system, said method further comprising:

equipping said electrostatic precipitator with a second drive system that drives said second rapping arrangement; and configuring said control system to control said second drive system such that a driving of said first rapping arrangement and a driving of said second rapping arrangement occur at least in part simultaneously.

12. A method of rapping an electrostatic precipitator comprising a flue gas chamber, a collecting electrode, a first rapping arrangement comprising a hammer, a rotating shaft and a shock bar that raps said collecting electrode, and a dust hopper, said method comprising:

rapping, by means of a second rapping arrangement comprising a hammer, a rotating shaft and a shock bar located within both said flue gas chamber and said dust hopper, together defining an inner chamber, at least one of said dust hopper and an element located within said dust hopper.

13. The method of claim 12, wherein said rapping by means of said second rapping arrangement comprises rapping at least one of:

an inner wall of said dust hopper;

a structural element located within said dust hopper and connected to at least one inner wall of said dust hopper;

a rapping plate located within said dust hopper proximate to an inner wall of said dust hopper; and a baffle located within said dust hopper.

14. The method of claim 12, wherein said first rapping arrangement comprises a rapping hammer mounted on a rotating shaft and said second rapping arrangement comprises a rapping hammer mounted on a rotating shaft, for raps of the rapping hammers against the shock bars once per rotation of the rotating shafts.

15. The method of claim 7, wherein the shock bar of the second rapping arrangement is supported by a plurality of guides.

* * * * *